US008230687B2

(12) United States Patent
Ziminsky

(10) Patent No.: US 8,230,687 B2
(45) Date of Patent: Jul. 31, 2012

(54) MULTI-TUBE ARRANGEMENT FOR COMBUSTOR AND METHOD OF MAKING THE MULTI-TUBE ARRANGEMENT

(75) Inventor: Willy Steve Ziminsky, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 992 days.

(21) Appl. No.: 12/202,791

(22) Filed: Sep. 2, 2008

(65) Prior Publication Data

US 2010/0050642 A1 Mar. 4, 2010

(51) Int. Cl.
*F02C 1/00* (2006.01)
*F02G 3/00* (2006.01)

(52) U.S. Cl. ..... 60/740; 60/742; 60/746; 60/747

(58) Field of Classification Search ..... 60/740, 60/742, 746, 747; 239/548, 549, 533.3, 556, 239/558, 398, 418, 419, 419.5, 423, 433, 239/434

See application file for complete search history.

(56) References Cited

U.S. PATENT DOCUMENTS

| | | | | |
|---|---|---|---|---|
| 4,763,481 | A * | 8/1988 | Cannon | 60/737 |
| 4,845,952 | A | 7/1989 | Beebe | |
| 7,093,438 | B2 | 8/2006 | Dinu et al. | |
| 7,185,494 | B2 | 3/2007 | Ziminsky et al. | |
| 2007/0131796 | A1 * | 6/2007 | Hessler | 239/424 |

* cited by examiner

*Primary Examiner* — Ehud Gartenberg
*Assistant Examiner* — Craig Kim
(74) *Attorney, Agent, or Firm* — Nixon & Vanderhye, P.C.

(57) ABSTRACT

A fuel injector tube includes a one piece, unitary, polygonal tube having an inlet end and an outlet end. The fuel injector tube further includes a fuel passage extending from the inlet end to the outlet end along a longitudinal axis of the polygonal tube, a plurality of air passages extending from the inlet end to the outlet end and surrounding the fuel passage, and a plurality of fuel holes. Each fuel hole connects an air passage with the fuel passage. The inlet end of the polygonal tube is formed into a fuel tube. A fuel injector includes a plurality of fuel injector tubes and a plate. The plurality of fuel tubes are connected to the plate adjacent the inlet ends of the plurality of fuel injector tubes.

11 Claims, 4 Drawing Sheets

MULTI-TUBE ARRANGEMENT FOR COMBUSTOR AND METHOD OF MAKING THE MULTI-TUBE ARRANGEMENT

STATEMENT REGARDING FEDERALLY SPONSORED RESEARCH OR DEVELOPMENT

This invention was made with Government support under Contract No. DE-FC26-05NT42643 awarded by the Department of Energy. The Government has certain rights in this invention.

FIELD OF THE INVENTION

The present invention relates to a fuel injector tube and a fuel injector including a plurality of fuel injector tubes.

BACKGROUND OF THE INVENTION

Industrial gas turbines have a combustion section typically formed by an annular array of combustors. Each combustor is a cylindrical chamber which receives gas and/or liquid fuel and combustion air which are combined into a combustible mixture. The air-fuel mixture burns in the combustor to generate hot, pressurized combustion gases that are applied to drive a turbine.

The combustors are generally dual mode, single stage multi-burner units. Dual mode refers to the ability of the combustor to burn gas or liquid fuels. Single stage refers to a single combustion zone defined by the cylindrical lining of each combustor.

Stabilizing a flame in a combustor assists in providing continuous combustion, efficient generation of hot combustion gases and reduced emissions from combustion. For multi-tube premixers it is desirable to closely pack the tubes to minimize the recirculation zones at the exit plane and provide a practical air-side effective area. Multi-venturi tube premixers are one example of multi-tube premixers.

U.S. Pat. Nos. 4,845,952 and 4,966,001 disclose a multiple venturi tube device that employs a plurality of closely spaced parallel venturi tubes disposed in a pair of spaced-apart header plates. The venturi tubes are brazed to the header plates and the perimeters of the header plates are sealed to form a plenum into which pressurized gaseous fuel is supplied. The venturi tubes are arranged in a circular pattern that creates numerous large and irregularly shaped recirculation zones at their exit plane. These large and irregular recirculation zones result in poor flame holding resistance at the exit of the premixer.

U.S. Pat. No. 7,093,438 disclose a gas fuel injector includes a first header plate; a second header plate spaced downstream from the upstream header plate; and a plurality of venturi tubes arranged in rows and sealably secured to the first and second header plates. Each of the venturi tubes includes an inlet section, a throat section and an exit. The exit is shaped into a pattern that reduces space between each of the venturi tubes at the exit of each of the plurality of venturi tubes.

BRIEF DESCRIPTION OF THE INVENTION

According to one embodiment of the invention, a fuel injector tube comprises a one piece, unitary, polygonal tube comprising an inlet end and an outlet end. The fuel injector tube further comprises a fuel passage extending from the inlet end to the outlet end along a longitudinal axis of the polygonal tube, a plurality of air passages extending from the inlet end to the outlet end and surrounding the fuel passage, and a plurality of fuel holes. Each fuel hole connects an air passage with the fuel passage. The inlet end of the polygonal tube is formed into the fuel tube.

According to another embodiment of the invention, a fuel injector comprises a plurality of fuel injector tubes and a plate. The plurality of fuel injector tubes fuel tubes are connected to the plate adjacent the inlet ends of the plurality of fuel injector tubes.

According to a further embodiment of the invention, a method of manufacturing a fuel injector tube comprises machining a plurality of first holes through a one piece, unitary, polygonal prism, the plurality of holes being spaced from the longitudinal axis of the prism; machining a second hole through the prism, the second hole being along the longitudinal axis; machining a plurality of third holes adjacent a first end of the prism through the sides of the polygonal prism at an angle to the first and second holes, the third holes extending from the sides of the prism to the second hole; and machining a second end of the prism to form a fuel tube.

DETAILED DESCRIPTION OF THE INVENTION

Figure 1:
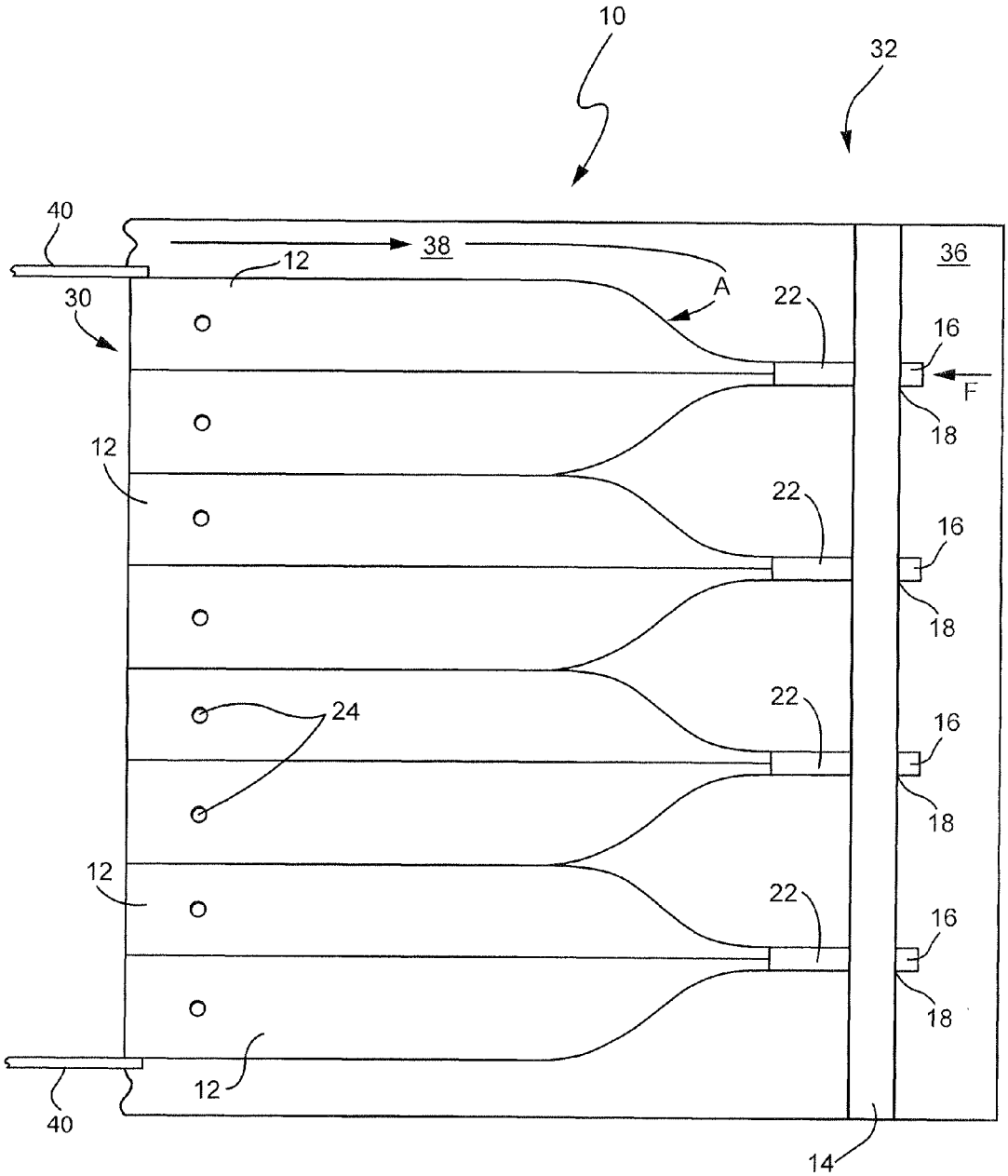
FIG. 1 schematically illustrates a fuel injector according to an embodiment of the invention.
Figure 2:
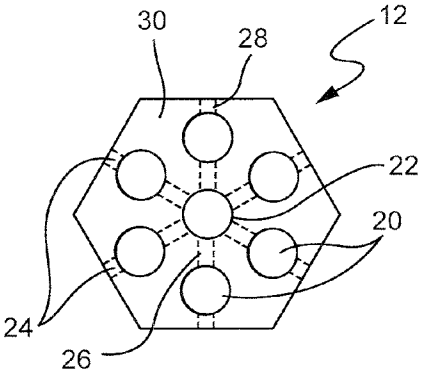
FIG. 2 schematically illustrates an end elevation view of a fuel injector tube according to an embodiment of the invention.

Referring to FIG. 1, a fuel injector 10 includes a plurality of fuel injector tubes 12. Each fuel injector tube 12 has an inlet end 32 and an outlet end 30 (FIG. 2). The fuel injector tubes 12 are supported at the inlet ends 32 by a plate 14. The inlet ends 32 of the fuel injector tubes 12 are connected to the plate 14 at 18. Each connection 18 may be, for example, a weld or a braze. The fuel injector tubes 12 are put through the plate 14 and welded or brazed on the inside to create the fuel plenum 36. The fuel injector tubes 12 may be also be connected by, for example, a direct metal laser sintering process. A flow of fuel F is provided from the fuel plenum 36 to inlets 16 of fuel passages 22 of the fuel injector tubes 12 on the inlet sides 32. A flow or air A is provided from an air plenum 38 to air passages 20 (FIG. 2) of the fuel injector tubes 12. A combustion liner 40 is provided around the fuel injector tubes 12.

Figure 3:
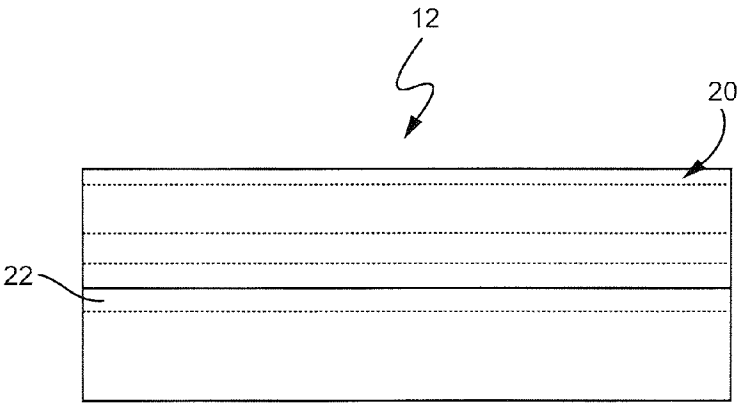
FIG. 3 is a side elevation view of the fuel injector tube of FIG. 2.

Referring to FIGS. 2 and 3, each fuel injector tube 12 includes a fuel passage 22 extending along the longitudinal axis of the fuel injector tube 12. The plurality of air passages 20 are each also formed parallel to the longitudinal axis of the fuel injector tube 12. For clarity, only one air passage 20 is shown in hidden lines in FIG. 3. Each fuel injection tube 12 includes a plurality of fuel holes 24 that connects the air passages 20 to the fuel passage 22. As shown in FIGS. 2 and 3, each fuel injector tube 12 has a polygonal shape and the fuel passage 22 is formed in the center of the fuel injector tube 12 and the air passages 20 are formed around the perimeter of the fuel injector tube 12. As also shown in FIGS. 2 and 3, the fuel injector tube 12 is hexagonal and six air passages 20 are formed around the perimeter of the hexagonal fuel injection tube 12. It should be appreciated, however, that the fuel injector tube 12 may have another polygonal shape, for example, an octagonal or pentagonal shape. It should also be appreciated that although the fuel passage 22 and the air passages 20 are depicted as circular, they may be oval or elliptical or polygonal.

Figure 5:
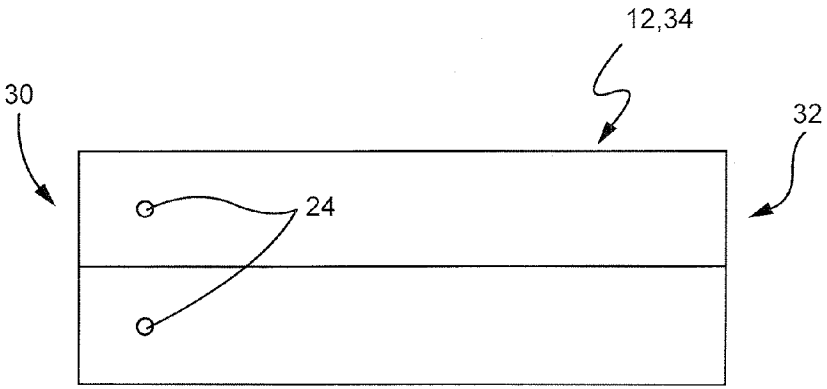
FIG. 5 schematically illustrates the fuel injector tube of FIG. 4 including the fuel holes.
Figure 4:
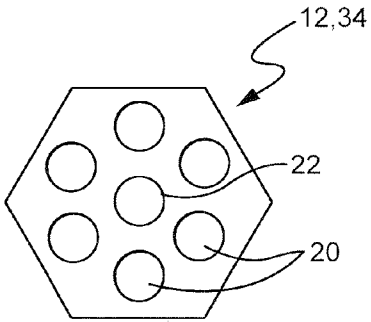
FIG. 4 schematically illustrates a polygonal starting piece for the fuel injector tube including the fuel passage and air passages.

Referring to FIGS. 4 and 5, each fuel injector tube 12 is formed from a one piece, unitary, solid polygonal starting piece, or prism, 34. The fuel passage 22 is formed through the center of starting piece 34, for example, by drilling. The air passages 20 are also formed through the starting piece 34 by, for example, drilling. As shown in FIG. 4, the fuel holes 24 are drilled into the starting piece 34 to connect the air passages 20 to the fuel passage 22. Referring again to FIG. 2, each fuel hole 24 includes an inside hole 26 that connects the fuel passage 22 to each air passage 20. Each fuel hole 24 also includes an outside, or dummy, hole 28 that extends from the air passage 20 to the outer perimeter of the fuel injector tube 12. The outside, or dummy, holes 28 do not affect the operation of the fuel injector tube 12 and do not need to be plugged.

Figure 6:
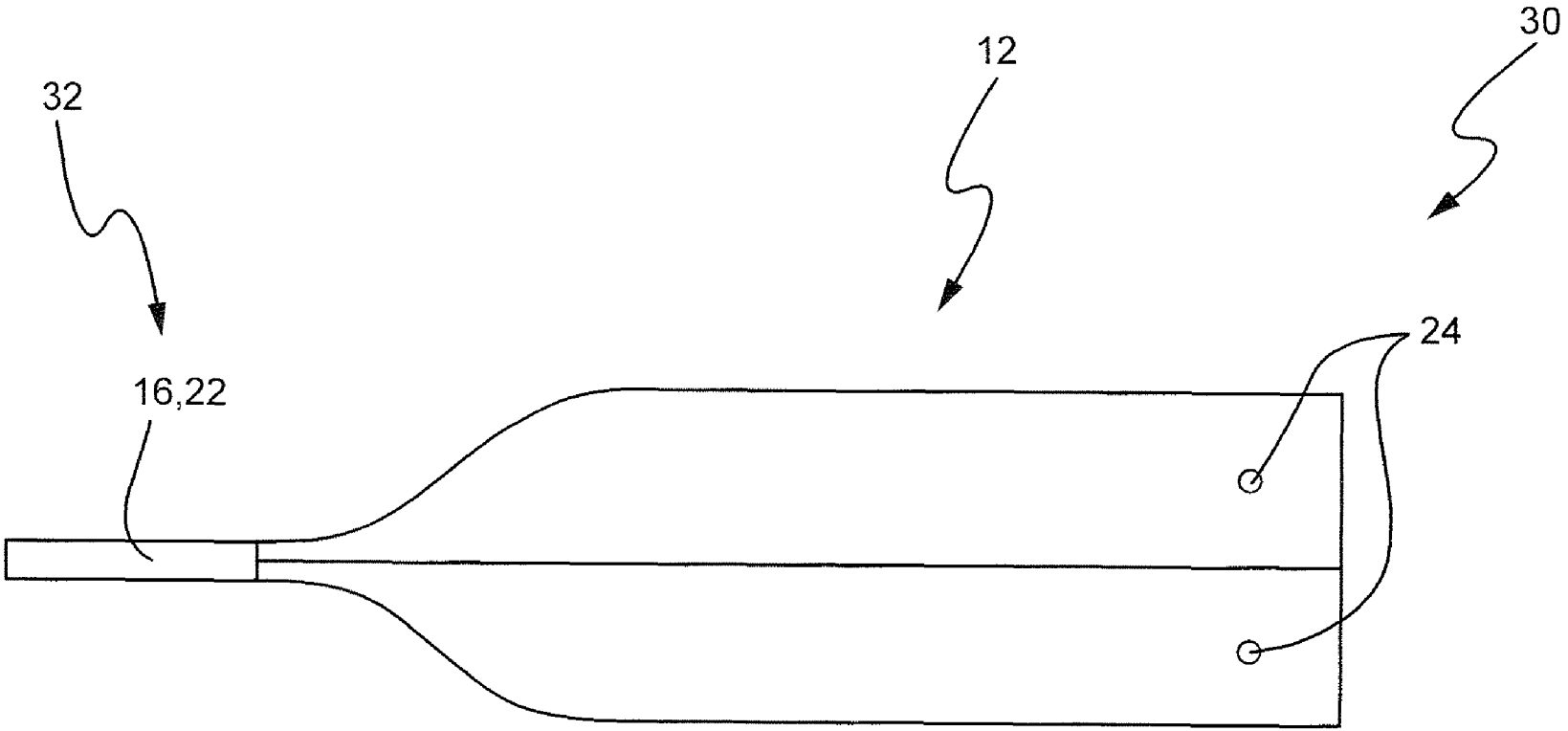
FIG. 6 schematically illustrates the fuel injector tube including the venturi outlet.

Referring to FIG. 6, each fuel injector tube 12 is machined at the inlet end 32 to produce a fuel tube. The inlet end 32 of the fuel tube 12 is, for example, turned to until the fuel passage 22 forms the fuel tube inlet 16.

Figure 7:
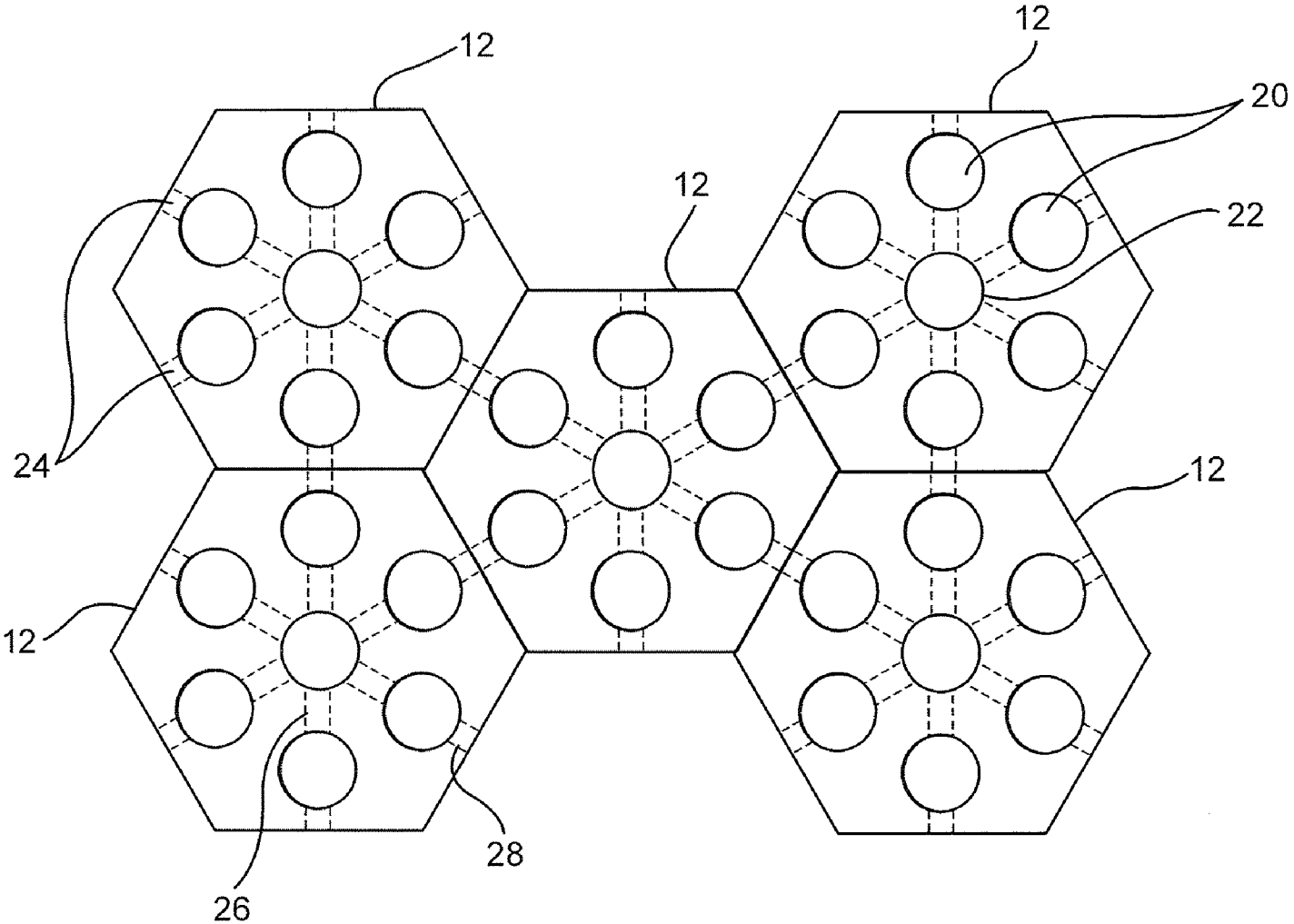
FIG. 7 schematically illustrates a fuel injector according to an embodiment of the invention.

Referring to FIG. 7, the fuel injector comprises a cluster of fuel tubes 12. In the embodiment shown in FIG. 7, the cluster comprises six fuel injector tubes 12 which are arranged in a "showerhead" configuration. As shown in FIG. 7, the showerhead has a honeycomb pattern. The honeycomb pattern is held together but not constrained to allow for differential thermal growth in the fuel injector tubes 12. Referring back to FIG. 1, the fuel injector tubes 12 are put through the plate 14 and welded or brazed on the inside to create the fuel plenum 36.

The fuel injector 10 shown in FIGS. 1 and 7 reduces the number of sealed tube ends. In the shell and tube construction of the prior art, each tube end must be sealed. However, the fuel injector 10 shown in FIGS. 1 and 7 only requires one tube end to be sealed, and only one of every six tubes needs to be sealed. The fuel injector 10 is fabricated using the polygonal shaped fuel injector tubes that are bundled together in a way that they can free float to avoid thermally induced stresses.

The fuel injector 10 shown in FIGS. 1 and 7 may be used for premixed high hydrogen combustion. The fuel injector 10 provides excellent fuel to air mixing, greater surface to volume ratio (quenching for flashback), and small fuel holes and low jet penetration (for flashback).

The bundling, or clustering, of tubes and the creation of a fuel plenum to feed them allows the number of tubes to be reduced. For example, bundling the hexagonal tubes of the embodiments disclosed herein allows the number of "sealed" tubes to be reduced by a factor of six.

The fuel injector tubes are not connected to each other and may "free float" with respect to one another to allow for differential thermal growth and prevent thermally induced stresses.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel injector tube, comprising:

a one piece, unitary, polygonal tube comprising an inlet end and an outlet end, the polygonal tube further comprising a fuel passage extending through the polygonal tube from the inlet end to an axial end surface of the outlet end along a longitudinal axis of the polygonal tube, a plurality of air passages extending through the polygonal tube from the inlet end to the axial end surface of the outlet end and surrounding the fuel passage, and a plurality of fuel holes, each fuel hole connecting an air passage with the fuel passage, wherein the inlet end of the polygonal tube is formed into a fuel tube, wherein each fuel hole extends from an outer peripheral surface of the polygonal tube to the fuel passage.

2. A fuel injector tube according to claim 1, wherein the number of air passages corresponds to the number of sides of the polygonal tube.

3. A fuel injector tube according to claim 1, wherein the fuel holes are adjacent the outlet end.

4. A fuel injector tube according to claim 1, wherein the polygonal tube is hexagonal.

5. A fuel injector, comprising:

a plurality of fuel injector tubes, each fuel injector tube comprising a one piece, unitary, polygonal tube comprising an inlet end and an outlet end, the polygonal tube further comprising a fuel passage extending through the polygonal tube from the inlet end to an axial end surface of the outlet end along a longitudinal axis of the polygonal tube, a plurality of air passages extending through the polygonal tube from the inlet end to the axial end surface of the outlet end and surrounding the fuel passage, and a plurality of fuel holes, each fuel hole connecting an air passage with the fuel passage, wherein the inlet end of the polygonal tube is formed into a fuel tube, wherein each fuel hole extends from an outer peripheral surface of the polygonal tube to the fuel passage; and a plate, wherein the plurality of fuel injector tubes are connected to the plate adjacent the inlet ends of the plurality of fuel injector tubes.

6. A fuel injector according to claim 5, wherein the plurality of fuel injector tubes comprises six fuel injector tubes.

7. A fuel injector according to claim 5, wherein the plurality of fuel tubes are connected to the plate by welds, brazes, or sinters.

8. A fuel injector according to claim 5, wherein the plurality of fuel tubes are not connected to each other.

9. A fuel injector according to claim 5, wherein the plurality of fuel injector tubes are arranged in a honeycomb pattern.

10. A fuel injector according to claim 5, further comprising a fuel plenum and an air plenum, wherein the plate separates the fuel plenum from the air plenum.

11. A fuel injector according to claim 5, further comprising a combustion liner around the plurality of fuel injector tubes.

* * * * *